US005082273A

United States Patent [19]

Matsumoto et al.

[11] Patent Number: 5,082,273

[45] Date of Patent: Jan. 21, 1992

[54] SLIP STORING APPARATUS

[75] Inventors: Kazuji Matsumoto, Kanagawa; Mitsuo Uchimura, Shizuoka; Tsugio Shiozaki, Shizuoka; Osamu Koizumi, Shizuoka; Ikuzo Sugiura, Kanagawa; Yoshihiko Sugimoto, Shizuoka, all of Japan

[73] Assignee: Tokyo Electric Co., Ltd., Tokyo, Japan

[21] Appl. No.: 545,698

[22] Filed: Jun. 29, 1990

[30] Foreign Application Priority Data

Jun. 30, 1989 [JP] Japan ..... 1-168753

[51] Int. Cl.[5] ..... B65H 43/04

[52] U.S. Cl. ..... 271/215; 271/181; 83/94

[58] Field of Search ..... 271/213, 214, 215, 177, 271/180, 181, 185, 198, 207, 314, 10, 306, 207; 83/94

[56] References Cited

U.S. PATENT DOCUMENTS

| | | | |
|---|---|---|---|
| 2,822,171 | 2/1958 | Lunning . | |
| 2,933,314 | 4/1960 | Stobb | 271/215 |
| 3,865.365 | 2/1975 | Hardin et al. | 271/214 |
| 4,361,318 | 11/1982 | Stobb | 271/215 |
| 4,478,402 | 10/1984 | Kane | 271/274 |
| 4,509,739 | 4/1985 | Kurokawa | 271/215 |
| 4,512,263 | 4/1985 | Lanning | 271/181 |
| 4,518,160 | 5/1985 | Lambrechts et al. | 271/214 |
| 4,603,629 | 8/1986 | Pou | 101/226 |
| 4,643,626 | 2/1987 | Noguchi et al. | 414/103 |
| 4,844,438 | 7/1989 | Mistyurik et al. | 271/181 |
| 4,974,826 | 12/1990 | Svyetsky et al. | 271/215 |

FOREIGN PATENT DOCUMENTS

| | | |
|---|---|---|
| 0049718 | 10/1980 | European Pat. Off. . |
| 1148191 | 8/1956 | Fed. Rep. of Germany . |
| 2624830 | 12/1988 | France . |
| 58-197148 | 11/1983 | Japan . |

*Primary Examiner*—H. Grant Skaggs

*Attorney, Agent, or Firm*—Oblon, Spivak, McClelland, Maier & Neustadt

[57] ABSTRACT

A slip storing apparatus for storing slips successively issued by a slip issuing machine. The slip storing apparatus comprises: a conveying mechanism for conveying slips issued by the slip issuing machine in one direction, and a slip storing unit having a slip support surface for supporting slips at their lower edges, declined to the rear at an angle to a horizontal plane, and a movable slip holding member having a slip holding surface substantially perpendicular to the slip support surface and supported for movement along a plane including the slip support surface.

14 Claims, 4 Drawing Sheets

SLIP STORING APPARATUS

FILED OF THE INVENTION AND RELATED ART STATEMENT

The present invention relates to a slip storing apparatus for regularly conveying slips issued by a slip issuing machine and storing the slips in a stack.

A conventional slip storing apparatus comprises a conveying mechanism, such as a belt conveyor unit, connected to the slip issuing unit of a slip issuing machine to convey slips issued by the slip issuing unit, a slip storing unit for storing the slips conveyed thereto by the conveying mechanism in a stack, downwardly extending from the extension of the conveying path of the conveying mechanism and having a movable slip holding member for holding the slips in a stack, capable of being moved gradually by the weight of the slips as the number of the slips delivered thereto increases.

In storing the slips in the slip storing apparatus, the slips conveyed sideways along the conveying path are raised up in an upright position by one surface of the movable slip holding member so that the slips are leaned against the movable slip holding member. Since the the movable slip holding member is set so that its slip supporting surface is inclined at an obtuse angle to the slip support surface of the slip storing unit, the slips are liable to fall sideways. Accordingly, the succeeding slip is liable to slide along the backside of the preceding slip in being set in an upright position, and hence it is difficult to stack the slips regularly.

OBJECT AND SUMMARY OF THE INVENTION

Accordingly, it is a first object of the present invention to provide a slip storing apparatus capable of regularly stacking slips issued by a slip issuing machine in a slip storing unit.

It is a second object of the present invention to provide a slip storing apparatus capable of smoothly storing slips delivered thereto by intermittently moving back a movable slip holding member according to the number of slips delivered thereto.

It is a third object of the present invention to provide a slip storing apparatus capable of avoiding the overflow of slips by stopping at least driving means for driving a slip issuing machine and a movable slip holding member upon the storage of a predetermined number of slips in a slip storing unit.

It is a fourth object of the present invention to provide a slip storing apparatus provided with an effectively protected stack sensor which provides a signal for controlling a movable slip holding member.

It is a fifth object of the present invention to provide a slip storing apparatus capable of delivering slips issued by a slip issuing machine to a slip storing unit without allowing the slips to zigzag.

It is a sixth object of the present invention to provide a slip storing apparatus capable of surely conveying slips issued by a slip issuing machine so that the slips are delivered smoothly to a slip storing unit.

In one aspect of the present invention, a slip storing apparatus comprises: a conveying mechanism for conveying slips issued by a slip issuing machine in one direction; and a slip storing unit provided with a slip support member having a slip support surface extended downward from the extension of the conveying path of the conveying mechanism to support the slips at their lower edges, and a movable slip holding member having a slip holding surface substantially perpendicular to the slip support surface and capable of moving along the slip support surface.

A slip issued by the slip issuing machine is conveyed to the slip storing unit by the conveying mechanism, and then the slip is leaned against the slip holding surface of the movable slip holding member capable of moving along the slip support surface of the slip support member. The slip holding surface substantially perpendicular to the slip support surface prevents the slip resting on the slip holding surface of the movable slip holding member falling sideways on the slip support surface, so that the slide of the succeeding slip along the backside of the preceding slip previously delivered to the movable slip holding member is prevented and hence the slips can be stacked regularly. Thus, a fixed space is secured at all times at the inlet of the slip storing unit to receive the slips smoothly into the slip storing unit from the conveying mechanism.

A stack sensor having a contact member capable of coming into contact with the slip leaned against the slip holding surface of the movable slip holding member is disposed opposite to the slip holding surface of the movable slip holding member, and driving means for driving the movable slip holding member is connected to the stack sensor. The stack sensor and the driving means move the movable slip holding member backward intermittently according to the number of the slips leaned against the slip holding surface of the movable slip holding member, so that the slips can smoothly be delivered to the slip storing unit.

A full-storage detector may be disposed at the terminal end of the path of the movable slip holding member, and switch means for breaking at least either a driving circuit for driving driving means for driving the slip issuing machine or a driving circuit for driving the driving means for driving the movable slip holding member is connected to the full-storage detector. Upon the storage of a fixed number of slips in the slip storing unit, the full-storage detector provides a signal to make the switch means break at least either the driving circuit for driving the driving means for driving the slip issuing machine or the driving circuit for driving the driving means for driving the movable slip holding member in order to prevent the overflow of the slip storing unit by stopping at least either the driving means for driving the slip issuing machine or the driving means for driving the movable slip holding member.

A separating plate may be disposed between the terminal end of the conveying mechanism and the inlet of the slip storing unit to protect effectively the contact member of the stack sensor.

A pair of rotary members are disposed at the terminal end of the conveying mechanism and a pair of presser rollers are placed in contact respectively with the rotary members to deliver a slip to the slip storing unit. The pair of presser rollers are supported for free rotation on the respective extremities of individual swing arms to deliver the slip to the slip storing unit without allowing the slip to zigzag.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
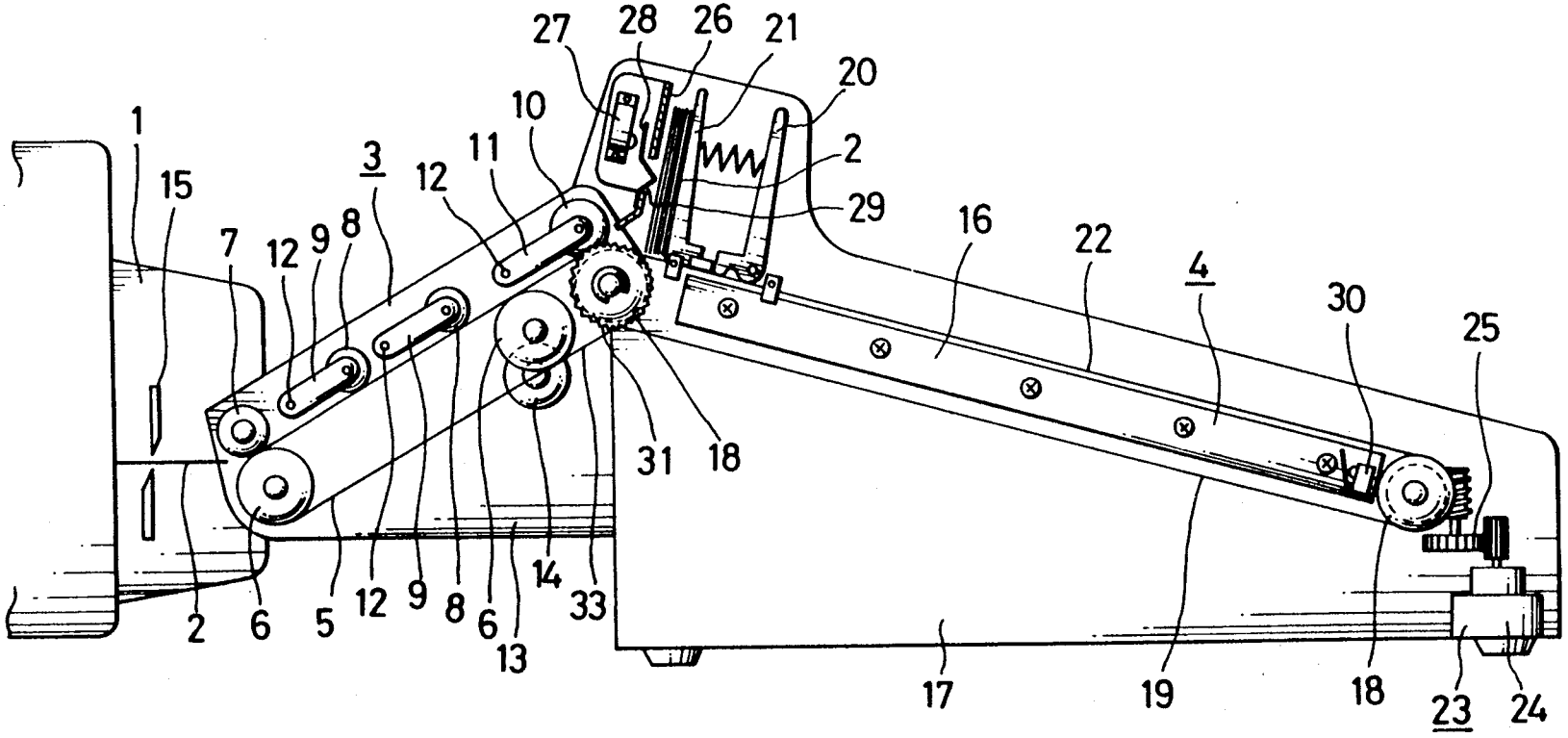
FIG. 1 is a side elevation of a slip storing apparatus in a preferred embodiment according to the present invention.

Referring to FIG. 1, a conveying mechanism 3 conveys slips 2 issued by a slip issuing machine 1 like a slip printer to a slip storing unit 4.

The conveying mechanism 3 comprises a rear pulley 6 disposed near the slip storing unit 4, a front pulley 6 disposed near the slip issuing machine 1, a conveyor belt 5 extended between the front and rear pulleys 6, a front presser roller 7 placed opposite to the front pulley 6 so as to be in contact with the conveyor belt 5, intermediate presser rollers 8, pairs of swing arms supporting the intermediate presser rollers 8 for free rotation at their extremities, respectively, a pair of rear presser rollers 10, swing arms 11 respectively supporting the rear presser rollers 10 for free rotation on their extremities, and a frame 13 supporting the foregoing components. The swing arms 9 and 11 are supported respectively on shafts 12 for swing motion thereon. A first driving unit 14 for driving the rear pulley 6 is mounted on the frame 13. The first driving unit 14 has a power transmission train like a gear train to transmit the rotative force of a motor to the rear pulley 6. The conveying mechanism 3 is inclined upward toward the slip storing unit 4. The slip issuing machine 1 is provided with an internal print unit, not shown, and a cutter 15 for cutting a printed slip 2 off a paper strip.

Figure 2:
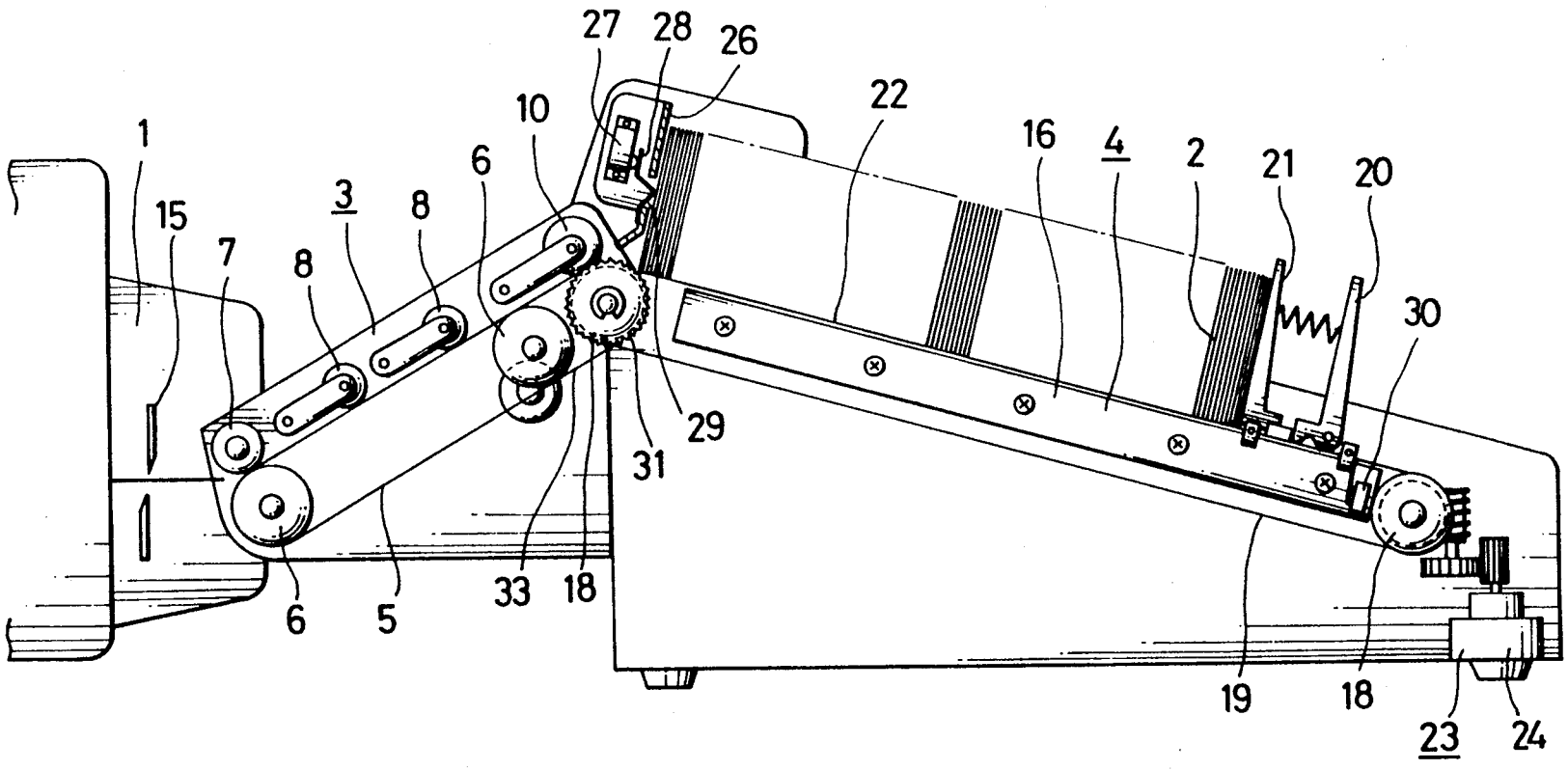
FIG. 2 is a side elevation of the slip storing apparatus of FIG. 1, showing a slip storing unit storing slips to its utmost storage capacity.
Figure 3:
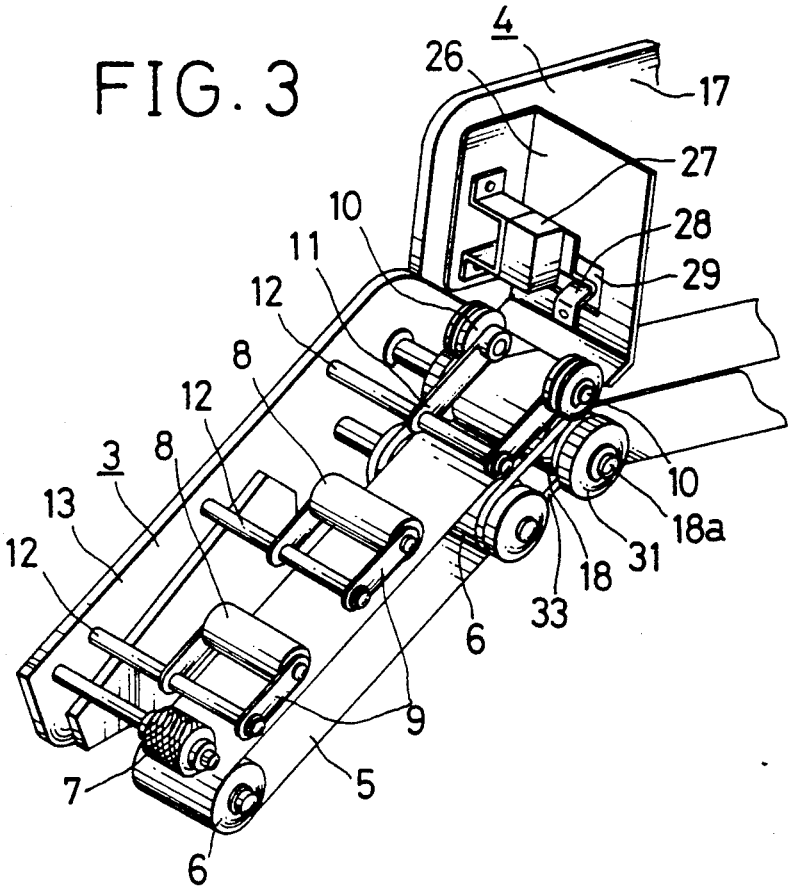
FIG. 3 is a perspective view of a conveying mechanism employed in the slip storing apparatus of FIG. 1.

The slip storing unit 4 comprises a frame 17, only one side member of which is shown in FIG. 1 and 2, a guide plate 16 fixed to the frame 17 with its front end disposed near the rear end of the conveying mechanism 3 and declined toward the rear end of the frame 17, a front pulley 18 disposed in front of the front end of the guide plate 16 and supported for rotation on the frame 17, a rear pulley 18 disposed behind the rear end of the guide plate 16 and supported for rotation on the frame 17, an endless belt 19 extended between the front and rear pulleys 18 and guided by the guide plate 16 so as to form a slip support surface 22 for supporting the slips 2, a movable slip holding member 20 having a slip holding surface 21 and fixed to the upper side of the endless belt 19 with its slip holding surface 21 perpendicular to the slip support surface 22 of the endless belt 19, a second driving unit 23 comprising a reversible motor 24 and a gear train 25 for transmitting the rotative force of the motor 24 to the rear pulley 18 and mounted on the frame 17 to drive the rear pulley 18, a separating plate 26 having a lower portion bent so as to extend along the upper side of the conveyor belt 5 and supported on the inner surfaces of the side members of the frame 17 at the front end of the frame 17 so as to be moved for positional adjustment toward and away from the slip holding surface 21 of the movable slip holding member 20, a stack sensor (microswitch) 27 connected to a driving circuit for driving the motor 24, attached to the front side of the separating plate 26 so as to be moved for positional adjustment and provided with an elastic contact member 28 having a lower end fixed to the lower part of the front side of the separating plate 26, an overflow detector (microswitch) 30 attached to the rear end of the guide plate 16 so as to engage the movable slip holding member 20, a pair of toothed rollers 31 provided with teeth 32 on their circumference and supported for free rotation on the shaft 18*a* supporting the front pulleys 18 disposed near the rear end of the conveying mechanism 3.

A portion of the contact member 28 of the stack sensor 27 projects through an opening 29 formed in the separating plate 26 toward the slips 2 stacked on the movable slip holding member 20 so as to be bent elastically by the slip 2 to turn on the stack sensor 27.

When the slips 2 are stored in the slip storing unit 4 to the utmost storage capacity of the latter, the full-storage detector provides a signal to stop the driving unit 14 for driving the slip issuing machine 1 and the conveying mechanism 3, and the motor 24.

The toothed rollers 31 have a radius that makes the teeth 32 of the toothed rollers 31 project upward from the conveying path of the conveying mechanism 3.

Figure 4:
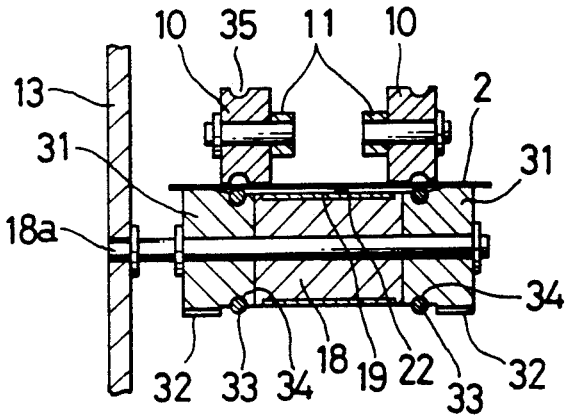
FIG. 4 is a longitudinal sectional view of toothed delivery rollers and presser rollers.
Figure 5:
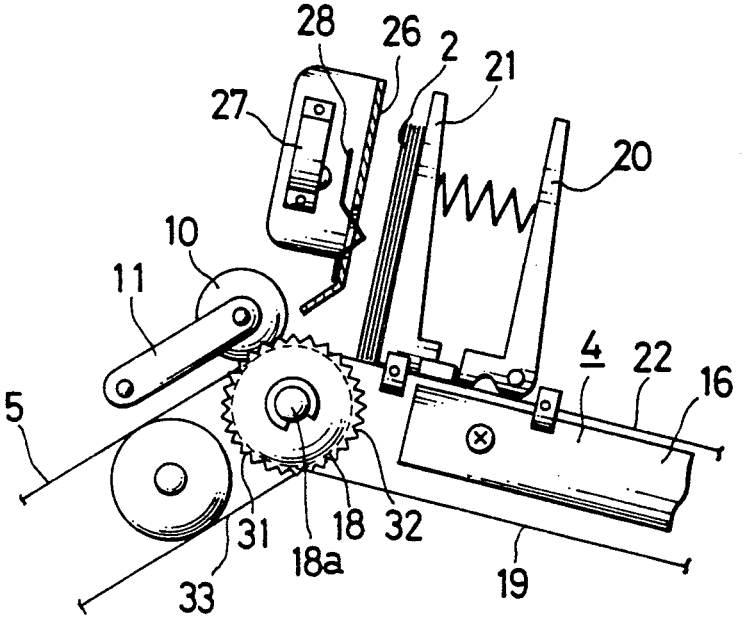
FIGS. 5 and 6 are side elevations of assistance in explaining the function of a stack sensor employed in the slip storing apparatus of FIG. 1.
Figure 6:
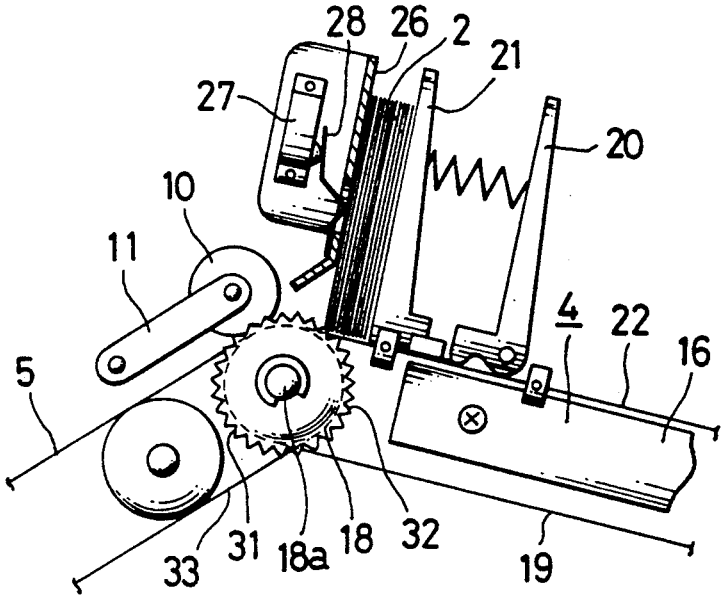

As shown in FIG. 4, the rear pulley 6 of the conveying mechanism 3 and the toothed rollers 31 are provided with annular grooves 34 and are operatively interlocked with each other by round belts 33 engaging the annular grooves 34. The rear presser roller 10 is provided with annular grooves 35 at its opposite ends to avoid interference between the rear presser roller 10 and the round belts 33.

In an initial state, the movable slip holding member 20 is located at its home position near the separating plate 26 at a fixed distance from the separating plate 26. A slip 2 issued by the slip issuing machine 1 is conveyed by the cooperative action of the conveyor belt 5, the front presser roller 7 and the intermediate presser rollers 8 and the leading edge of the slip 2 is caused to strike against the slip holding surface 21 (or a preceding slip 2 leaned on the slip holding surface 21). As the slip 2 is urged further toward the movable slip holding member 20 by the conveying mechanism 3, the slip 2 is raised along the slip holding surface 21 so as to be leaned against the slip holding surface 21. The teeth 32 of the toothed rollers 31 projecting upward from the upper surface of the conveyor belt 5 engage the trailing edge of the slip 2 pressed against the conveyor belt 5 by the rear presser rollers 10 without fail to urge the slip 2 positively toward the slip storing unit 4 and, consequently, the slip 2 is delivered smoothly into a space between the separating plate 26 and the slip holding surface 21 without stagnating between the outlet of the conveying mechanism 3 and the inlet of the slip storing unit 4. The rear presser rollers 10 supported respectively on the extremities of the swing arms 11 individually supported for swing motion apply the same pressure to the slip 2 to prevent the zigzag movement of the slip 2. Since the slip support surface 16 of the slip storing unit 4 is declined to the rear, the slip 2 reclines on the slip holding surface 21, so that the slip 2 can stably be supported perpendicularly to the slip support surface 22.

In a state where a plurality of slips 2 are stored in a stack on the belt 19 and the contact member 28 is separated from the last slip 2 in the stack, the stack sensor 27 remains turned off. In a state where the slips 2 are stored in the slip storing unit 4 in a stack of a thickness sufficient to press the contact member 28, the contact member 28 is bent elastically to turn on the stack sensor 27. Consequently, the motor 24 is actuated to rotate the rear pulley 18 in a clockwise direction to move the slip holding member 20 backward to expand the interval between the slip holding surface 21 and the separating plate 26, so that the contact member 28 is allowed to return elastically to its initial position to turn off the stack sensor 27 and, consequently, the motor 24 is stopped. Thus, the motor 24 is actuated intermittently to expand the interval between the slip holding surface 21 and the separating plate 26 by intermittently moving the slip holding member 20. While the slip holding member 20 is at a stop, an appropriate interval is secured between the slip holding surface 21 and the separating plate 26, and hence the slips 2 do not fall sideways and the slips 2 leaned against the slip holding surface 21 are not raised frictionally by the succeeding slips 2. Thus, the slips 2 can be stored in a neat stack in the slip storing unit 4.

As slips 2 are issued successively and the number of the slips 2 stored in the slip storing unit 4 increases gradually, the movable slip holding member 20 is moved backward. Eventually, the movable slip holding member 20 engages the full-storage detector 30 to turn on the same, and then the full-storage detector 30 provides a signal to stop the motor 24 and to interrupt the slip issuing operation of the slip issuing machine 1 and the slip conveying operation of the conveying mechanism 3. Accordingly, even if the number of slips of a lot set for the slip issuing machine 1 exceeds the number of slips corresponding to the utmost storage capacity of the slip storing unit 4, the slip issuing operation of the slip issuing machine 1 is stopped automatically upon the coincidence of the number of slips issued by the slip issuing machine 1 with the utmost storage capacity of the slip storing unit 4 to prevent the excessive slips overflowing the slip storing unit 4. After the issuance of slips 2 has been interrupted by the agency of the full-storage detector 30, the stack of the slips 2 is removed from the slip storing unit 4, the movable slip holding member 20 is returned to its home position, and then the start switch, not shown, is operated to restart the slip issuing machine 1 for issuing the rest of the slips 2.

The separating plate 26 disposed at the inlet of the slip storing unit 4 prevents the slip 2 falling toward the stack sensor 27 even if the slip 2 is comparatively long. Since only a portion of the contact member 28 projects through the opening 29 formed in the separating plate 26, the contact member 28 is not exposed to an excessively high pressure and hence the contact member 28 does not undergo a permanent deformation.

The upper surface of the guide plate 16 may be used instead of the upper surface of the belt 19 as the slip support surface. When the upper surface of the guide plate 16 is used for supporting the slips 2, endless belts are extended respectively on the opposite sides of the guide plate 16 and the movable slip holding member 20 is fixed to the endless belts.

The present invention is applicable also to a tag storing apparatus combined with a tag issuing machine.

What is claimed is:

1. An apparatus for conveying and storing slips, said apparatus comprising:

a conveying mechanism and a slip storing unit, said conveying mechanism including a pair of toothed rollers for engaging a trailing edge of said slips to aid in conveying the slips to said slip storing unit;

a movable slip holding member having a slip holding surface for receiving the slips in a stack as they are conveyed to said slip storing unit, said movable slip holding member being fixed to an endless belt which extends around a front pulley and a rear pulley;

wherein said front pulley and said pair of toothed rollers are each rotatably mounted about a common axis.

2. The apparatus according to claim 1, further comprising:

a stack sensor disposed opposite to the slip holding surface of the movable slip holding member, said stack sensor being provided with contact means capable of engaging the stack of slips; and driving means for moving the movable slip holding member by driving the endless belt in response to a signal provided by the stack sensor.

3. The apparatus according to claim 2, wherein the contact means of the stack sensor is an elastic member capable of being elastically bent by pressure applied thereto by the stack of slips.

4. The apparatus according to claim 1, wherein said toothed rollers are driven by a first driving unit and wherein said endless belt is driven by a second driving unit.

5. The apparatus according to claim 4, further comprising:

a full-storage detector disposed at a rear terminal end of movement of the movable slip holding member, said fullstorage detector generating a signal in response to contact with said slip holding member to interrupt operation of at least one of said first driving unit and said second driving unit.

6. The apparatus according to claim 1, further comprising:

a slip support surface provided on said endless belt for supporting the slips at their lower edges, said slip support surface being declined toward the rear at an angle to a horizontal plane; and a separating plate disposed between a rear end of the conveying mechanism and the slip holding surface of the movable slip holding member.

7. The apparatus according to claim 1, further comprising:

a first swing arm rotatably supporting a first presser roller at a first end of said front pulley; and a second swing arm rotatably supporting a second presser roller at a second end of said front pulley;

wherein said first and second swing arms are individually biased toward the front pulley for individual swing motion.

8. An apparatus according to any one of claims 1, 2, 5, 6 and 7, wherein the conveying mechanism is inclined upward toward the slip holding surface of the movable slip holding member.

9. An apparatus according to any one of claim 1, 2, 5, 6, and 7, wherein the slip issuing machine is provided with a cutter for cutting a paper strip into slips having a desired length.

10. An apparatus according to any one of claim 1, 2, 5, 6, and 7, wherein the slip issuing machine is a printer.

11. The apparatus of claim 1, wherein said conveying mechanism includes a conveyor belt.

12. The apparatus of claim 1, wherein said conveying mechanism further includes a plurality of presser rollers biased against said conveyor belt.

13. The apparatus of claim 1, wherein said front pulley and said pair of toothed rollers are each rotatably mounted on a common shaft.

14. The apparatus of claim 1, wherein said toothed rollers are each provided with an annular groove, and wherein each of said toothed rollers is driven by a round belt engaged with its annular groove.

* * * * *